United States Patent [19]

Bochan

[11] 4,321,809

[45] Mar. 30, 1982

[54] WASHING MACHINE

[75] Inventor: John Bochan, Louisville, Ky.

[73] Assignee: General Electric Company, Louisville, Ky.

[21] Appl. No.: 183,864

[22] Filed: Sep. 4, 1980

[51] Int. Cl.[3] ..... D06F 39/08

[52] U.S. Cl. ..... 68/207

[58] Field of Search ..... 68/18 D, 181 R, 184, 68/207, 208

[56] References Cited

U.S. PATENT DOCUMENTS

| | | | |
|---|---|---|---|
| 2,934,928 | 5/1960 | Shelton | 68/207 |
| 2,955,448 | 10/1960 | Olthuis | 68/12 R |
| 3,153,924 | 10/1964 | Alger | 68/207 X |
| 3,274,808 | 9/1966 | Morey | 68/23R |
| 4,077,239 | 3/1978 | Platt et al. | 68/53 |

*Primary Examiner*—Philip R. Coe

*Attorney, Agent, or Firm*—H. Neil Houser

[57] ABSTRACT

An agitator type washing machine having a tub, a fabric receiving basket mounted in the tub, a recirculating pump for recirculating liquid from the tub to the basket during wash and rinse operations, and a liquid sensor responsive to the volume of liquid retained in the tub, which operatively combine to automatically control the volume of liquid delivered to the washing machine during each fill operation according to the size of the clothes load in the basket. Vertically spaced tiers of drain holes are formed in the sidewall of the basket to permit liquid flow from the basket to the tub. The tiers are arranged such that when the liquid level in the basket is lower than the lowermost tier unimpeded by the load in the basket, liquid flow from the basket, impeded by the load, is exceeded by the liquid flow into the basket from the tub and from the external supply, causing liquid to accumulate in the basket, but not in the tub. When the liquid level in the basket rises to the level of the lowermost unimpeded tier, cumulative liquid flow from the basket through the impeded and unimpeded tiers exceeds the liquid flow into the basket, causing liquid to accumulate in the tub. The level sensor is operative to terminate fill and enable agitation upon detection of the accumulation of a predetermined volume of washing liquid in the tub.

16 Claims, 6 Drawing Figures

WASHING MACHINE

BACKGROUND OF THE INVENTION

This invention relates to fabric washing machines of the type having a fabric receiving basket disposed within an outer tub, wherein fabrics are washed in the basket and washing liquid is continuously recirculated from the tub to the basket during wash and rinse operations. More particularly, the invention relates to an improvement in such machines in which the amount of water delivered into the machine during each fill operation is automatically determined by the size of the fabric load contained in the basket.

One type of fabric washing machine in which this invention is particularly advantageous is the domestic clothes washing machine. In such machines, the size of the load of clothes to be washed varies considerably; such machines may be used at full capacity, but may as well be used for substantially smaller loads. Clearly, using the amount of water necessary for a full load for only a small load results in water and energy being wasted in both wash and rinse cycles. On the other hand, using insufficient water for a relatively large load may result in poor wash results and possible damage to the clothes. Various common ways of solving this problem have required the user to estimate the approximate weight or volume of the clothes and select a water level accordingly. When the size of the load is correctly estimated, these approaches work satisfactorily. However, inaccurate load estimates may result in the aforementioned problems of excess water usage, inadequate washing action, and possible damage to the clothes.

It is desirable, therefore, to relieve the user of this burden by providing a washing machine in which the amount of water metered into the machine is automatically controlled to the proper amount to assure satisfactory washing and rinsing of the particular wash load without a need for user estimates. Commonly assigned U.S. Pat. No. 2,934,928, entitled "Clothes Washer with Means for Automatically Providing the Correct Water Level" issued to Winston L. Shelton, teaches one approach which employs a single ring of intermediate level apertures either in the outer basket wall or through the agitator center post to provide fluid communication between basket and tub. The packing density of the clothes load, is relied upon to impede the flow of liquid from the basket to the tub through the basket apertures during fill. When a sufficient head of liquid is accumulated in the basket, liquid flows from the basket to the tub at a rate which permits liquid to accumulate in the tub. Upon accumulation of a predetermined amount of liquid in the tub, the fill valve is closed, and agitation and recirculation begin. If, during the wash and rinse cycles, the liquid level in the tub drops below a second predetermined amount, agitation and recirculation stop and the fill valve again opens to provide additional liquid to the basket. This process is repeated through the wash and rinse cycles until sufficient liquid to wash the particular load as indicated by relieved packing is provided. Thus, the Shelton patent teaches use of the packing together of clothes, that is the packing density of the wash load, as the measure for controlling liquid level. In Shelton, either the inflow of fresh liquid or the recirculation of the liquid in the tub occurs continuously during wash and rinse operations, but not both simultaneously.

While the Shelton approach may work satisfactorily for loads comprised substantially of cotton fiber or other natural fiber fabrics, it has been empirically determined that loads comprised essentially of synthetic fibers due to their increased pliability, particularly in hot water, tend to pack together much more than natural fiber loads requiring more liquid in the basket to relieve the packing than is necessary for satisfactory wash results. Consequently, the Shelton approach would tend to over compensate for the size of such a load and use an excessive amount of washing or rinsing liquid in the basket.

Recognizing that a significant portion of modern wash loads generally include synthetic fabrics, it is desirable to provide a means for automatically controlling the liquid level in the basket which avoids the shortcomings of the prior art and which works satisfactorily for all types of fabric loads.

It is, therefore, a prime object of the present invention to provide a fabric washing appliance which automatically controls liquid level in the basket in accordance with the size of the fabric load to be washed independently of the packing density of the fabric for level control, and which works satisfactorily for both natural and synthetic fabrics.

It is a further object of the present invention to provide a fabric washing appliance which automatically controls the amount of liquid delivered into the appliance during each fill operation in accordance with the level of clothes or fabric received in the basket.

It is a further object of the present invention to provide a fabric washing appliance of the aforementioned type which permits agitation of the fabric in the basket only when a sufficient amount of liquid is present in the basket.

SUMMARY OF THE INVENTION

There is provided in accordance with the present invention a fabric washing appliance of the agitator type having a liquid receiving system comprised of a tub, a fabric receiving basket mounted within the tub and a recirculating means for recirculating liquid from the tub to the basket during wash and rinse operations, and a liquid level sensor responsive to the volume of liquid in the tub, which are operatively combined to automatically control the volume of liquid delivered to the liquid receiving system during each fill operation in accordance with the size of the load of fabric received in the basket. The basket has formed in the sides thereof a plurality of vertically spaced tiers of apertures which permit liquid flow from the basket to the tub. When the level of fabrics in the basket is lower than a particular tier the flow through the apertures of that tier is unimpeded; but when the level of fabrics in the basket is above that tier the fabrics impede flow through the apertures of that tier permitting flow only at an impeded flow rate significantly less than the unimpeded flow rate. Each tier is arranged to permit unimpeded flow from the basket to the tub at a flow rate which is less than the next lower tier, and which, when combined with the cumulative impeded flow rate of all lower tiers, provides a total flow rate which exceeds the flow rate of the recirculating means; the cumulative impeded flow rate of all tiers being less than this recirculating means flow rate. During fill operation, the relationship between total flow rate from the basket to the tub and the recirculating flow rate from the tub into the basket causes the liquid level in the basket to rise to the level of the lowermost unimpeded tier before liquid begins to accumulate in the tub. Thereafter, fill continues until liquid accumulating in the tub triggers the level sensor which is operative to terminate fill and enable agitation upon detection of a predetermined volume of liquid in the tub. Thus, the volume of liquid delivered to the system is automatically determined by the level of fabrics in the basket, and agitation is permitted only when a sufficient amount of liquid is present in the basket.

DETAILED DESCRIPTION OF THE INVENTION

The subject matter which I regard as my invention is particularly pointed out and distinctly claimed in the concluding portion of this specification. However, both as to organization and manner of operation, my invention may be best understood by reference to the following description and accompanying drawings.

Figure 1:
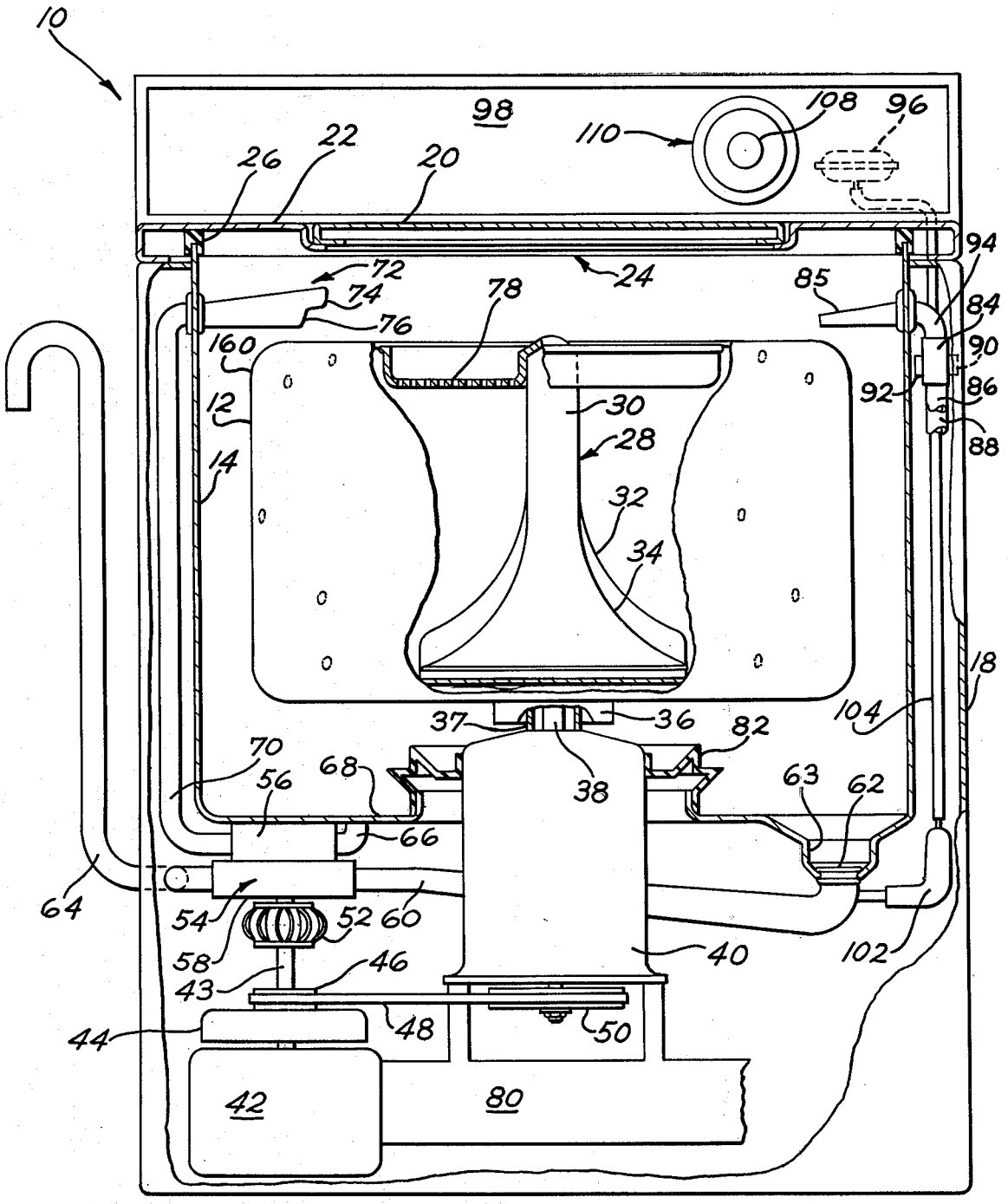
FIG. 1 is a schematic front elevational view of a clothes washing machine illustratively embodying one form of the present invention, the view having portions cut away to show certain interior features.

FIG. 1 shows an agitator-type clothes washing machine 10 having a clothes receiving basket 12 combined within an outer imperforate tub 14 which serves as a liquid receptacle. Basket 12 may be provided with a balance ring 16 provided near the top thereof to help steady the basket when it is rotated at high speed.

Tub 14 is rigidly mounted within an appearance cabinet 18 by any suitable means. A lid 20 hingedly mounted to the top portion 22 of cabinet 18 affords access to the interior of cabinet 18 through top opening 24. Gasket 26 forms a seal between the top of tub 14 and top portion 22 of the cabinet to prevent the escape of moisture and moist air into the cabinet around the tub.

A vertical axis agitator 28 is generally centrally positioned within basket 12. Agitator 28 includes a center post 30 and a plurality of water circulating vanes 32 joined at their lower edges by an outwardly flared skirt portion 34. Both basket 12 and agitator 28 are rotatably mounted. Basket 12 is mounted on a rotatable hub 36 which is secured to drive tube 27 which extends upwardly from transmission 40. Agitator 28 is secured to a drive shaft 38 which extends upwardly from transmission assembly 40 through drive tube 37 and hub 36 and through center post 30.

Basket 12 and agitator 28 may be driven by any suitable means. In the illustrative embodiment, the driving means includes a reversible electric motor 42 and an electromagnetic clutch 44 coupled to motor output drive shaft 43. Clutch 44 includes an output hub 46 connected by means of a suitable drive belt 48 to input pulley 50 of transmission assembly 40. Clutch 44 is effective to drive pulley 50 in either direction of motor rotation. Transmission assembly 40 is so arranged that it supports and drives both agitator drive shaft 38 and drive tube 37. When pulley 50 is driven in one direction by clutch 44, the transmission causes agitator 28 to oscillate; when pulley 50 is driven in the opposite direction by reversing the direction of rotation of motor 42, the transmission 40 causes basket 12 to rotate at high speed for centrifugal extraction of liquid therefrom. Transmission assembly 40 may be conventional.

For reasons which will become apparent further on, it is desirable to provide an operating mode for clutch 44 and transmission 40 which allows motor 42 to drive the recirculation pump 56 during fill without driving the agitator. This capability is provided by clutch 44 when in its neutral mode. Clutch 44 may be an electromagnetic clutch of the type described in commonly assigned U.S. Pat. No. 3,463,285, which issued to Robert R. Sisler on Aug. 26, 1969, which is hereby incorporated by reference. Clutch 44 includes an electromagnetic coil (represented schematically in FIG. 5 as neutral control 132) which when fully energized is operative to drive output hub 46 and thus pulley 50 at the speed of motor 42. De-energization of the electromagnetic coil places the clutch in its neutral mode in which hub 46 and pully 50 are effectively disengaged from the motor drive shaft 43. The details of transmission 40 and clutch 44 form no part of the present invention and have been omitted for brevity.

In addition to operating transmission assembly 40, motor 42 also provides a direct drive through flexible coupling 52, which is secured to motor drive shaft 43, to a pump structure generally indicated at 54, which includes two separate pump units, a recirculation pump 56 and a drain pump 58, both driven simultaneously in the same direction by motor 20. Drain pump 58 has an inlet connected by a conduit 60 to an opening 62 in a depression formed at 63, the lowermost point of tub 14, and an outlet connected by a conduit 64 to a suitable drain (not shown). The circulation pump 56 has an inlet connected by a conduit 66 to an opening 68 in the tub bottom and an outlet connected by a conduit 70 to a split flow recirculation nozzle 72. Nozzle 72 has an upper flow chamber 74 and a lower flow chamber 76. Upper chamber 74 is arranged to direct a portion of recirculated liquid into the basket through filter pan 78 secured on the top portion of agitator 28 for rotation therewith. Lower chamber 76 directs the remainder of the recirculated flow directly into the basket. The pumps are formed so that in the spin direction of motor rotation drain pump 58 will draw in liquid from opening 62 through conduit 60 and discharge it through conduit 64 to drain, and in the other direction of rotation recirculation pump 56 will draw in liquid through conduit 66 and discharge it through conduit 70 and nozzle 72, each of the pumps being substantially inoperative in the direction of rotation in which it is not used.

With this structure then, when the motor is rotating in the direction to provide agitation, pump 56 draws liquid through conduit 66 from tub 14 and discharges it through conduit 70 so that the liquid passes from nozzle 72 with a portion going into filter pan 78 and the balance flowing directly back into the basket. The portion entering filter pan 78 passes down through a number of small openings (not shown) provided in the bottom of the filter pan and back into basket 12. In this manner filter pan 78 causes a portion of the lint which is separated from the clothes during a washing operation to be filtered out of the water and thus prevents it from being redeposited on the clothes.

Motor 42, clutch 44, neutral 46, transmission assembly 40, agitator 28 and basket 12 form a suspended washing and centrifuging system which is supported by the stationary structure of the machine so as to permit isolation of vibrations from the stationary structure. It will be understood that such vibrations occur primarily as a result of high speed spinning of basket 12 with a load of clothes therein. While any suitable suspension may be used, one suitable structure includes a bracket member 80 with the transmission assembly 40 mounted on top thereof and motor 42 mounted to one end thereof. The bracket is in turn connected to cables (not shown) supported from the top of the machine. Since the details of the suspension system form no part of the present invention, only a portion of the suspension system is shown in the drawings. A suspension system of the type suitable for use in the illustrative embodiment is fully described in commonly assigned U.S. Pat. No. 2,987,190, issued on June 6, 1961 to John Bochan, which is hereby incorporated by reference.

In order to accommodate the movement which occurs between basket 12 and tub 14 without leakage between them, a flexible boot 82 is joined to the tub 14 and the upper portion of transmission 40. Member 82 may be of any suitable configuration, many of which are known in the art, to permit relative motion of the parts to which it is joined and to prevent leakage therebetween.

Liquid supply means for delivering fresh liquid to the machine include a conventional mixing valve structure 84 and inlet nozzle 85. Conduits 86 and 88, respectively, couple inlet valve structure 84 with sources of hot and cold water (not shown). Inlet valve structure 84 includes solenoids 90 and 92. Conduits 86 and 88 are connected to inlet valve structure 84 such that energization of solenoid 90 permits passage of hot water through a valve to a hose 94, and energization of solenoid 92 permits passage of cold water through the valve to hose 94, and energization of both solenoids 90 and 92 permits mixing of hot and cold water in the valve, with the mixture passing into hose 94. Hose 94 connects the output port of inlet valve structure 84 to inlet nozzle 85. In the illustrative embodiment of FIG. 1, inlet nozzle 85 is positioned to discharge into basket 12 so that when either one or both solenoids 90 and 92 are energized, water passes into basket 12. However, alternatively, nozzle 85 could be positioned to discharge directly into tub 14, relying upon the recirculation pump to deliver liquid to the basket.

Liquid level sensing means responsive to the volume of liquid in tub 14 is provided and is operative to shut off the liquid supply means upon sensing a predetermined volume of liquid in tub 14. The level sensing means can be one of many suitable configurations known in the art. The liquid level sensing means employed in the illustrative embodiment comprises a conventional pressure sensitive switch device 96 positioned behind the control panel 98 of machine 10. Pressure switch 96 senses the pressure head created for the level of water in tub 14 by means of an air chamber 104 which is connected to a sensing diaphragm in switch 96 via conduit 102. An opening 100 is located in depression 63. Opening 100 is connected to pressure switch 96 through air chamber 104 and conduit 102. As water rises in the tub increasing pressure is exerted on the air trapped in chamber 104. At a predetermined pressure level corresponding to a predetermined volume of liquid in tub 14, the pressure exerted on the column of air trips switch 96 to shut off the liquid supply means by interrupting and preventing energization of solenoids 90 and 92. The details of the level sensing means are not part of the present invention and have been omitted for brevity. However, a suitable level sensing arrangement for use with the present invention is described in detail in commonly assigned U.S. Pat. No. 4,168,615 to Condit, which is hereby incorporated by reference.

It is to be understood that while the fill control switch terminates the fill operation when the volume of liquid in tub 14 reaches a predetermined volume, the liquid in the tub represents only a small portion of the liquid in the liquid receiving system comprised of basket 12, tub 14, and recirculation pump 56 and associated conduits 66 and 70. A substantial portion of the liquid sufficient to provide satisfactory wash performance is retained in basket 12 when clothes are present in the basket. It is the purpose of the present invention to provide means for automatically controlling the volume of liquid delivered to the system during each fill operation in accordance with the size of the load of clothing or other fabric material in the basket as reflected by the level of clothing in the basket.

To this end, in accordance with the present invention the clothes basket is provided with a plurality of individual vertically spaced flow means, each one of which is constructed and arranged to permit liquid flow from the basket to the tub at a predetermined unimpeded flow rate when the level of clothing or fabric in the basket is lower than that particular flow means. When the level of fabric is above that flow means, liquid flows from the basket to the tub at an impeded flow rate as a result of interference of the clothes. Ideally, the unimpeded flow rate for each one of the flow means when combined with the cumulative impeded flow rate from each of the lower flow means provides a total flow rate of liquid from the basket to the tub which at least equals the total rate of flow of liquid into the basket. This total rate of flow into the basket in the illustrative embodiment is comprised of the flow rate of the recirculating means which continuously recirculates liquid from the tub to the basket throughout the wash and rinse cycles and the fill means which delivers fresh water to the basket during each fill operation. The cumulative impeded flow rate of all impeded flow means is less than the flow rate of the recirculating means. As a result of this relationship of total flow rate from the basket to the tub comprising the unimpeded and impeded flow rates to the rate of flow of liquid into the basket from the fill means and the recirculating means, the level of liquid in the basket stabilizes at the level of the lowermost flow means through which flow is unimpeded by the fabric or clothing contained in the basket. As fill continues, the rate of flow from the basket to the tub exceeds the flow rate of the recirculation means causing liquid to accumulate in the tub. Fill is terminated when a predetermined volume of liquid accumulates in the tub.

To more fully appreciate the manner of operation of the present invention, assume a load of clothes or other fabric articles present in the basket. During fill, water flows into the basket from the fill means and the recirculating means and seeps slowly through those flow means impeded by the clothing. The rate of flow into the basket is greater than the cumulative impeded flow rate out of the basket causing the water level in the basket to rise. Eventually the water level in the basket reaches the flow means just above the level of clothes. At this point, water flows to the tub through this flow means at its unimpeded flow rate. This unimpeded flow rate in combination with the cumulative impeded flow rate of all of the lower flow means provides a total flow rate from the basket to the tub which at least equals the total rate of flow of water into the basket causing the water level in the basket to stabilize at this level. As fill continues, since this rate of flow from the basket to the tub exceeds the recirculation rate, water accumulates in the tub until a predetermined volume of water in the tub is sensed by the liquid level sensing means which then terminates fill by de-energizing the fill solenoid(s).

Figure 2:
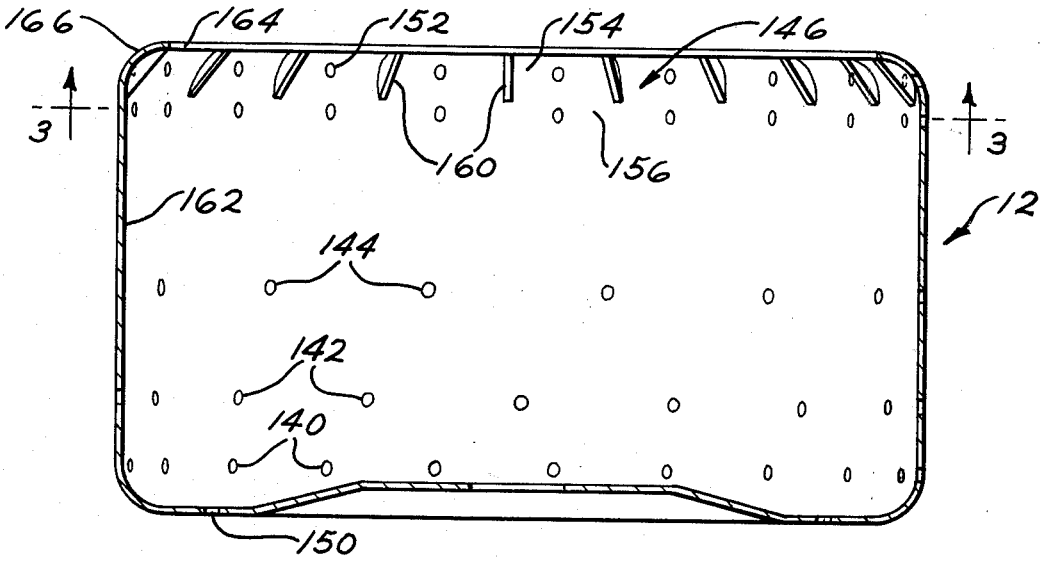
FIG. 2 is a cross sectional view of the clothes basket from the clothes washing machine of FIG. 1.

As best seen in FIGS. 1 and 2, in basket 12 of the illustrative embodiment each individual flow means comprises a tier or series of apertures distributed generally horizontally about the periphery of the basket, the apertures for each tier being designated 140, 142 and 144, respectively. The unimpeded flow rate through each successively higher tier is made less than the next lower tier by providing a smaller total cross-sectional flow area for that tier. This can be achieved in a number of ways such as by varying the size of the apertures, the number of apertures, or both. In the illustrative embodiment, the apertures for the plurality of tiers comprise drain holes of uniform size. Each successively higher tier includes fewer drain holes.

In addition to the drain holes comprising the flow means, basket 12 also has two additional sets of apertures. One set comprises a plurality of sand holes 150 distributed in an annular pattern in the bottom of basket 12 to enhance the egress of relatively heavy particulate matter from the basket. Typically, the unimpeded flow rate through sand holes 150 is less than the unimpeded flow rate of the lowermost tier of drain holes, but such an arrangement is not essential. The cumulative impeded flow rate of all flow means in combination with the impeded flow rate of the sand holes provides a total flow rate which is less than the flow rate of the recirculation pump. The other set of apertures comprises a set of overfill holes 152 distributed generally horizontally about the uppermost portion of the basket vertically displaced above the uppermost tier of drain holes 144 to provide overfill means. This overfill means is sized to permit liquid to flow from the basket to the tub at a rate greater than the input flow rate in order to prevent flow of liquid over the top of the basket, such as could otherwise occur if the level of clothing in the basket was above the uppermost tier of drain holes.

Clearly, for the liquid level in the basket to stabilize at the level of the lowermost unimpeded tier, the rate of flow from the basket must at least equal the rate of flow into the basket. To assure that this condition is satisfied, the total rate of flow into the basket must be known so that the drain hole geometry can be arranged accordingly. The rate of flow into the basket during fill in the illustrative embodiment is the total flow rate of the recirculating means and the fill means. The flow rate of the recirculating means is essentially known, being determined by the characteristics of the recirculation pump. However, the flow rate of the fill means may vary from locality to locality or even within localities due to typical variations in the water pressure of domestic water supplies. As a result of this variation in fill rate, this total flow rate condition may not always be satisfied. However, by arranging the tiers of apertures to satisfy this condition for a typical or nominal fill flow rate, satisfactory results can be obtained. In those instances where the actual flow rate for the fill means is excessive enough to cause the total rate of flow into the basket during fill to exceed the rate of flow out of the basket, the liquid level in the basket may rise above the level of the lowermost unimpeded tier to a level between the lowermost tier and the next higher tier. However, once the level of the lowermost tier is reached, liquid begins to accumulate rapidly in the tub. Consequently, fill will be terminated by the level sensing means before the liquid level in the basket increases significantly above the lowermost unimpeded tier.

Maximum liquid level overshoot occurs when the tiers of drain holes are arranged such that the total rate of flow from the basket, comprising the unimpeded flow from the lowermost unimpeded tier and the cumulative impeded flow of all lower tiers only slightly exceeds the flow rate of the recirculation pump, and the cumulative impeded flow of all tiers is less than the flow rate of the recirculation pump. Even in this arrangement once the liquid level in the basket rises to the level of the lowermost unimpeded tiers, liquid accumulates in the tub rapidly enough to terminate fill while the liquid level in the basket is not lower than the lowermost unimpeded tier and not higher than the next higher tier.

This problem of potential liquid level overshoot in the basket may be avoided by including a constant flow rate valve in the fill means or by modifying the fill means to direct fresh liquid directly into the tub rather than into the basket. The illustrative embodiment of FIG. 1 could be modified to incorporate this latter arrangement by simply reconfiguring nozzle 85 to direct water into tub 14 through the annular area between basket 12 and tub 14. In this latter arrangement, the tier drain holes can be arranged such that the unimpeded flow from the lowermost unimpeded tier at least equals the maximum recirculation rate and the cumulative impeded flow rate of all tiers is less than the recirculation rate. Thus, as soon as the lowermost unimpeded tier is reached the flow from the basket at least equals the flow rate of the recirculation pump means causing the level of liquid in the basket to stabilize. Additional liquid provided by the fill means causes accumulation of liquid in the tub which triggers the level sensing means to terminate fill.

In the illustrative embodiment the recirculation flow rate for recirculation pump 66 when operating at full pump capacity is approximately 17 gallons per minute and the fill rate is approximately 6 gallons per minute for a total input flow rate into the basket during fill operations of as much as approximately 23 gallons per minute. At this flow rate, satisfactory level control and wash and rinse results were obtained using the basket illustrated in FIG. 2 in which the various apertures are arranged as follows. Eight sand holes 150, each 0.170 inches in diameter, are symetrically distributed annularly about the basket bottom, the holes being radially spaced 2½ inches from the outer edge of basket 12.

All of the drain holes comprising the flow means are 0.208 inches in diameter. Tier 140 is vertically spaced 1.3 inches above the bottom of the basket and comprises 21 holes; tier 142 is vertically spaced 1.8 inches above tier 140 and comprises 16 holes; and tier 144 is vertically spaced 3.0 inches above tier 142 and comprises 14 holes.

Overfill means 146 comprises overfill holes 152 distributed about two relatively closely spaced horizontal rings 154 and 156. The overfill holes are 0.250 inches in diameter with a vertical spacing of 1 inch between rings 154 and 156. The lowermost ring 156 is vertically spaced $3\frac{3}{4}$ inches from uppermost drain hole tier 144.

Figure 3:
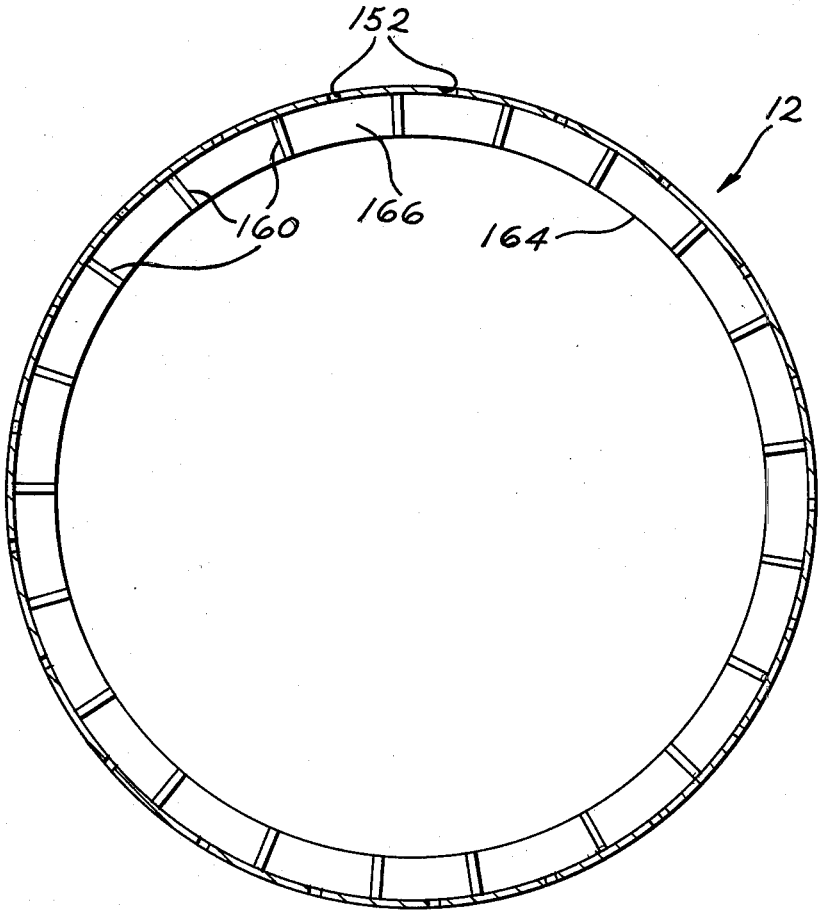
FIG. 3 is a cross-sectional view of the clothes basket of FIG. 2 taken along lines 3—3.

As best seen in FIGS. 2 and 3, overfill means 146 further comprises spacing ribs 160 which project radially inwardly from the sidewall 162 of basket 12 and extend between side wall 162 and the inner edge 164 of inwardly extending annular lip 166 of basket 12. Ribs 160 function to maintain a space between fabric articles in the basket and the overfill drain holes to prevent blockage of the drain holes and allow liquid to drain through overfill holes rather than over the top of the basket. Ribs 160 must be sufficiently horizontally closely spaced to prevent fabric articles in the tub from packing against overfill holes 152. As best seen in FIG. 3, ribs 160 are symmetrically distributed about the periphery of basket 12 with holes 152 being centered between adjacent ribs.

Figure 4:
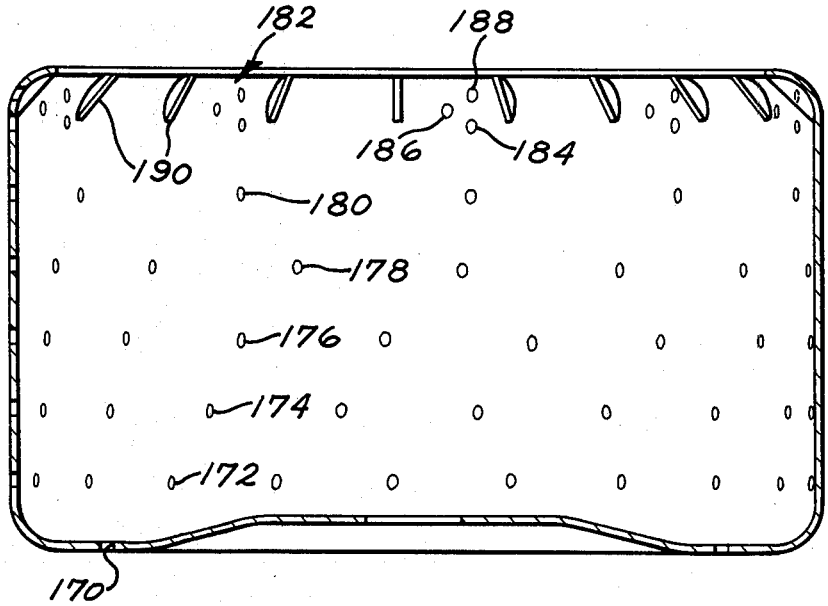
FIG. 4 is a cross-sectional side view of an alternative embodiment of a clothes basket for the clothes washing machine of FIG. 1.

An alternative embodiment for basket 12 is illustrated in FIG. 4, in which the drain hole pattern is changed to permit more flexibility in fill level selection by providing more tiers of drain holes. In this embodiment, eight sand holes 170, each having a diameter of 0.187 inches are annularly distributed about the basket bottom radially displaced $2\frac{1}{2}$ inches from the outer edge of basket 12. All of the drain holes comprising the flow means are 0.208 inches in diameter; with a uniform vertical spacing between each tier of $1\frac{7}{8}$ inches. Tier 172 comprises 21 holes; tier 174, 19 holes; tier 176, 17 holes; tier 178, 15 holes; and tier 180, 13 holes. The overfill holes 182 are 0.250 inches in diameter and are distributed about the basket in three relatively closely spaced horizontal rings 184, 186, and 188 of 13 holes each with a vertical spacing of $\frac{3}{8}$ inch between rings. Lowermost ring 184 is vertically spaced $1\frac{7}{8}$ inches from uppermost drain hole tier 180. Vertical ribs 190 are provided between the overfill holes as previously described with reference to FIGS. 2 and 3. Though this embodiment has not been tested, it is believed that it will perform at least as well as the embodiment of FIG. 2.

Figure 5:
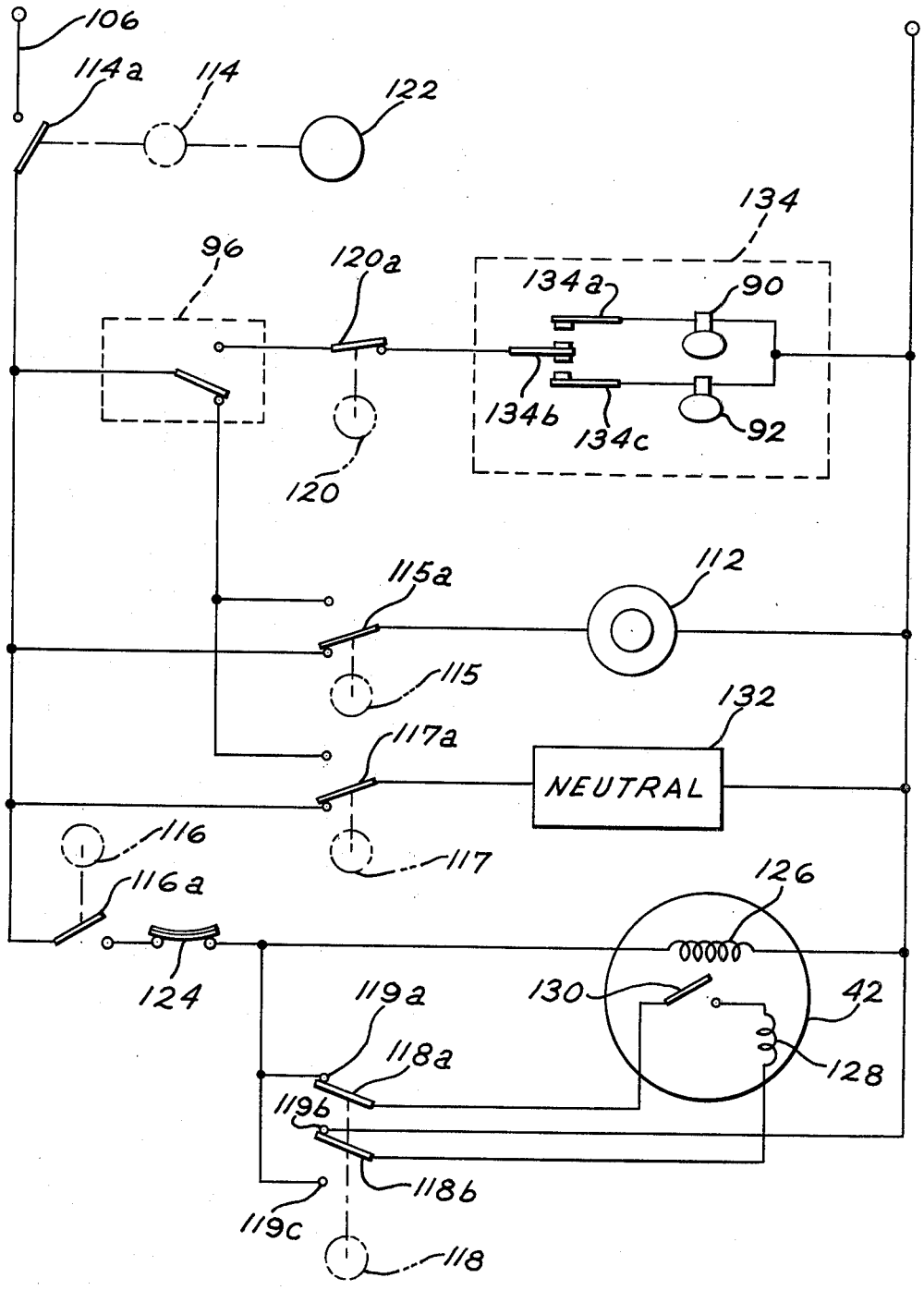
FIG. 5 is a schematic representation of an illustrative control circuit for the washing machine of FIG. 1.

Referring now to FIG. 5, an exemplary control circuit for controlling the illustrative washing appliance is shown in schematic form. It will be understood that washing appliances often include components in addition to those shown in FIG. 5. In the interest of simplicity and brevity, a number of components not relating to the present invention have been omitted.

Conductors 106 and 108 which are adapted for connection to a conventional 110 volt 60 Hz AC power supply such as an ordinary household electrical plug-in receptacle deliver power to the circuit. The cyclical operation of the various circuit components is controlled by a sequence control assembly designated 110 (FIG. 1) mounted to control panel 98. Sequence control assembly 110 comprises a timer motor 112, a plurality of cams 114, 115, 116, 117, 118 and 120 for controlling associated cam-actuated switches 114*a*, 115*a*, 116*a*, 117*a*, 118*a*, 118*b*, and 120*a* and a manually operable user control knob 122 extending from the control panel for user manipulation. The cams 114, 115, 116, 117, 118 and 120 and control knob 122 are mounted to a cam shaft driven by the drive shaft of timer motor 112. Each of the cam-actuated switches is mounted adjacent its associated cam in a manner well known in the appliance control art for sequential actuation of the various switches.

Cam-actuated switch 114*a* controls energization of the entire control circuit. When switch 114*a* is open, the power source is effectively disconnected and the machine is inoperative. Switch 114*a* is closed at the beginning of an operating cycle by user manipulation of control knob 122 and opened at the end of the cycle by timer motor 112.

Fill level control is provided by the serial connection of fill control switch 96, cam-actuated switch 120*a* and manually operable three position temperature selection switch 134. Switch 134 has three contacts 134*a*, 134*b* and 134*c*. Contact 134*a* is connected in series with hot water valve solenoid 90; contact 134*b* is connected in series with cam-actuated switch 120*a*; and contact 134*c* is connected in series with cold water valve solenoid 92. The hot water temperature is selected by moving contact 134*b* into contact with 134*a* thereby enabling energization of only solenoid 90 when switch 120*a* is closed so that only hot water is admitted to tub 14 during a fill operation. Cold water temperature is selected by moving contact 134*b* into contact with contact 134*c* thereby enabling energization of only solenoid 92 so that only cold water is admitted to tub 14 during a fill operation. Warm water temperature is selected by moving contact 134*b* into contact with both contacts 134*a* and 134*c* enabling the parallel energization of solenoids 90 and 92 so that a mixture of hot and cold water is admitted to tub 14 during fill. A fill operation is timer initiated by cam 120 closing switch 120*a*; the fill operation is terminated by the opening of fill switch 96 when the volume of liquid in tub 14 exceeds a predetermined level.

Timer motor 112 is serially connected to two-position cam switch 115*a*. Switch 115*a* is operative in its normally closed position, closed across contact NC, to serially connect timer motor 112 to the normally open contact of fill level control switch 96, and operative in its normally open position, closed across contact NO, to directly connect timer motor 112 across lines 106 and 108. Switch 115*a* is placed in its normally open position during wash and rinse cycles so that during these cycles energization of timer motor 112 is energized through fill level control switch 96 when switch 96 is in its normally open position and prevented when switch 96 is in its normally closed position. Early in the fill operation, switch 115*a* is switched by cam 115 to its normally open position, thereby de-energizing timer motor 112. When fill level control switch 96 switches to its normally open position to terminate fill upon the accumulation of a predetermined volume of liquid in the tub, timer motor 112 is energized and the wash or rinse operating cycle proceeds. Timer motor 112 is stalled in this manner during fill operations to insure complete fill regardless of the pressure of the liquid supply. After a wash or rinse cycle is completed, switch 115*a* is switched to its normally closed position to energize timer motor 112 during spin independently of the liquid level in the tub.

In order to avoid possible damage to fabric articles in basket 12, it is desirable to prevent agitation when the level of liquid in the basket is low, such as during fill; however, motor 42 must be energized during fill to drive recirculating pump 56. Electromagnetic clutch 44 permits motor 42 to operate throughout the wash and rinse cycles while permitting agitation only when switch 96 indicates a sufficient level of liquid in the tub.

The electromagnetic coil of clutch 44 is schematically represented in the circuit of FIG. 5 as neutral control 132. Control 132 is serially connected with two-position switch 117*a*. Switch 117*a* is operative in its normally closed position, closed across contact NC, to serially connect control 132 with the normally open contact NO of fill level switch 96 and in its normally open position, closed across its contact NO, to connect control 132 directly across power lines 106 and 108. As described hereinbefore, control 132 is operative when energized to drivingly couple motor 42 to transmission 40 for agitation or spin. When control 132 is de-energized, clutch 44 is placed in its neutral mode in which transmission 40 is functionally disengaged from motor 42. In the arrangement of FIG. 5, switch 117*a* is placed in its normally closed position during wash and rinse cycles so that during these cycles energization of control 132 is enabled through fill switch 96 when switch 96 is in its normally open position and prevented when switch 96 is in its normally closed position. During spin it is necessary to energize control 132 regardless of the amount of liquid in the tub. This is accomplished by switching switch 117*a* to its normally open position at the beginning of the spin operation.

Main drive motor 42 is serially connected with cam-actuated switch 116*a* and a conventional motor protection device 124. Motor 42 is of the conventional induction type having a main winding 126 and a start winding 128. Start winding 128 is serially connected to a centrifugal switch 130 for controlling energization of the start winding. Switch 130 operates in a conventional manner to enable energization of the start winding when the motor is idle or rotating below a predetermined speed and opens to switch start winding 128 out of the circuit when the motor achieves its normal running speed. Start winding 128 is connected in parallel to main winding 126 through cam-actuated switches 118*a* and 118*b*. When switches 118*a* and 118*b* are closed to contacts 119*a* and 119*b*, respectively, the polarity of run winding 128 causes motor 42 to rotate in the direction causing pump 66 to recirculate and enabling transmission 40 to oscillate agitator 28 for agitation of clothes in basket 12. When cam 118 switches 118*a* and 118*b* to close across contacts 119*b* and 119*c*, respectively, polarity of run winding 128 is reversed so that when motor 42 is started up again following a slowdown or stop allowing switch 130 to close, the motor will rotate in the opposite direction. When motor 42 rotates in this opposite direction, drain pump 58 is operative and spin of basket 12 is effected through transmission 40.

Figure 6:
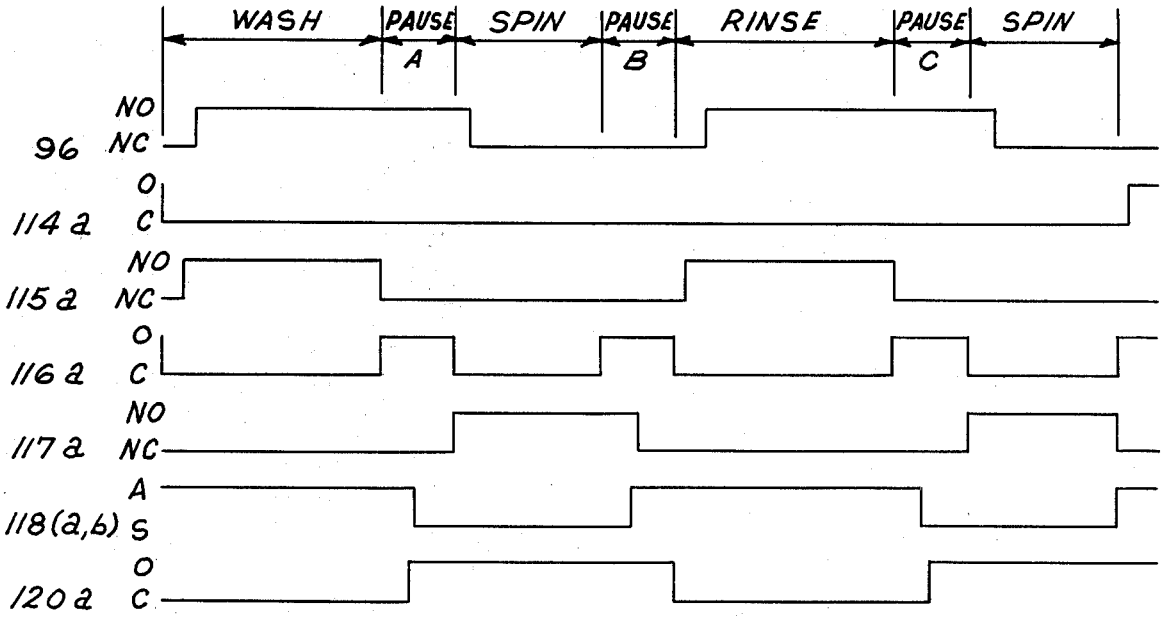
FIG. 6 is a timing chart schematically representing the action of the timer-controlled, cam-actuated switches in the circuit of FIG. 5 for a typical operating cycle.

Overall system operation for a representative operating cycle will be discussed with reference to the timing chart of FIG. 6. First, the user selects the desired water temperature. For this example, warm water is selected causing contact 134*b* to contact both contacts 134*a* and 134*c*. The user initiates cycle operation by manually manipulating control knob 122 to close switch 114*a*. Closure of switch 114*a* energizes timer motor 112 initially through switch 115*a* in its normally closed position (NC). Cam 116 closes switch 116*a* to energize the main winding 126 of main motor 42. Switches 118*a* and 118*b* are placed in their "agitate" position (A) closed across contacts 119*a* and 119*b*, respectively, thereby energizing start winding 128 through centrifugal switch 130, until the motor attains normal running speed causing switch 130 to open. Energization of motor 42 drives recirculation pump 56. Energization of neutral control 132 is initially prevented by switch 117*a* in its normally closed position, thereby preventing oscillation of agitator 28 by transmission 40, and switch 120*a* is closed energizing fill solenoids 90 and 92 through switch 134, causing a mixture of hot and cold water to enter basket 12 through fill nozzle 85. During the fill operation, switch 115*a* switches to its normally open (NO) position, de-energizing the timer motor 112. Timer motor 112 remains de-energized or stalled until sufficient liquid accumulates in the tub to switch level switch 96 to its normally open position.

In this example, a medium size load of clothing is placed in basket 12. The top of this load of clothes rises to the level slightly above drain hole series 142. As the water from nozzle 85 enters the basket, it seeps slowly through the drain holes and sand holes impeded by the clothing. The seepage which does flow to the tub is recirculated to the basket by recirculation pump 56, which has a pumping capacity of 17 gallons per minute. The combination of recirculated water and fresh water entering the basket causes the water level in the basket to rise since the input flow rate exceeds the total impeded flow rate from the basket. As the water level in the basket reaches the first unimpeded tier of drain holes which in this example is tier 144, the total flow rate of liquid from the basket to the tub comprising the unimpeded flow through tiers 144 and the impeded flow through tiers 140 and 142 and sand holes 150 exceeds the input flow causing the level in the basket to stabilize at the level of drain holes 144. From this point, the volume of liquid in the basket remains approximately constant. As fill continues, the additional water being added to the system causes water to accumulate in tub 14 until reaching a predetermined volume as sensed by level sensor switch 96, at which time switch 96 switches to its normally open position interrupting energization of the fill valve solenoids 90 and 92, and enabling energization of timer motor 112 through switch 115*a* and neutral control 132 through switch 117*a* which is in its normally closed position (NC). De-energization of solenoids 90 and 92 terminates fill; energization of timer motor 112 resumes timed cyclical operation; and energization of neutral control 132 initiates agitation by drivingly coupling transmission 40 to motor 42 to oscillate agitator 28. This steady state wash cycle condition continues until timer 112 terminates the first wash cycle by opening switch 116*a* to de-energize motor 42, and switching switch 115*a* to its normally closed position (NC) to place timer motor 112 directly across the power supply for direct energization during spin.

During pause A in which motor 42 is idle, switch 120*a* is opened to prevent energization of the fill solenoids during spin, and switches 118*a* and 118*b* are switched across contacts 119*b*, 119*c*, respectively, to reverse polarity of the start winding so that upon energization of motor 42 it will rotate in the opposite direction to operate drain pump 58 and to spin basket 12. Timer 112 terminates the pause and initiates a spin cycle by switching switch 117*a* to its normally open position to enable energization of neutral control 132 during spin and closing switch 116*a* to energize motor 42.

This general sequence is repeated for alternate wash or rinse and spin cycles, the liquid level in the basket for each wash and rinse cycle being automatically determined by the level of clothing in the basket in the manner just described. The last spin cycle is completed by timer 112 which opens switch 116*a* to de-energize the motor, returns switch 117*a* to its normally closed position, returns switches 118*a* and 118*b* to contacts 119*a* and 119*b*, respectively, and then opens switch 114*a* to disconnect the machine from the power supply.

While a specific illustrative embodiment of the invention has been described herein, it is realized that numerous modifications and changes will occur to those skilled in the art. It is therefore to be understood that the appended claims are intended to cover all such modifications and changes as fall within the true spirit and scope of the invention.

What is claimed is:

1. A fabric washing appliance comprising: a tub; a fabric receiving basket; recirculating means arranged to deliver liquid from said tub to said basket; and liquid supply means for delivering liquid to said basket; said basket having formed therein a plurality of individual vertically spaced flow means, each one of said flow means being constructed and arranged to permit liquid flow from said basket to said tub through said one of said flow means at a predetermined unimpeded flow rate when the level of fabrics in said basket is lower than said one flow means and to permit liquid flow through said one of said flow means at a lower, impeded flow rate when the level of fabrics in said basket is above said one of said flow means, the unimpeded flow rate through said one of said flow means, in combination with the cumulative impeded flow rate of any flow means lower than said one of said flow means, providing a total flow rate from said basket to said tub at least equal to the rate of flow of liquid into said basket from said liquid supply means and said recirculating means, the cumulative impeded flow rate through all of said flow means providing a total flow rate from said basket to said tub which is less than the flow rate of said recirculating means thereby stabilizing the liquid level in said basket at approximately the level of the lowermost flow means through which flow is unimpeded by the fabric in said basket, whereby the liquid level in the basket is automatically determined by the level of fabric in said basket.

2. A fabric washing appliance in accordance with claim 1 further comprising: liquid level sensing means responsive to the volume of liquid in said tub and operative to shut off said liquid supply means upon sensing a predetermined volume of liquid in said tub; means for washing fabrics in said basket including agitating means; means responsive to said liquid level sensing means and operative to prevent agitation by said agitating means when the volume of liquid in said tub is less than said predetermined volume and to enable agitation when the volume of liquid reaches said predetermined volume.

3. A fabric washing appliance in accordance with claim 1 or 2 wherein each of said individual flow means comprises a series of apertures distributed generally horizontally about the periphery of said basket.

4. A fabric washing appliance in accordance with claim 3 wherein the total cross-sectional area of each of said series of apertures is less than the total cross-sectional area of the next lower series of apertures.

5. A fabric washing appliance in accordance with claim 3 wherein each of said series of apertures comprises a plurality of drain holes of uniform size, and wherein each successively higher series includes fewer holes whereby the unimpeded flow rate for each series is less than the unimpeded flow rate of the next lower series.

6. A fabric washing appliance in accordance with claim 1 or 2 wherein said basket has formed in the bottom thereof a plurality of holes to enhance the egress of particulate matter from said basket, the cumulative impeded flow rate of all of said flow means in combination with the flow rate through said holes when impeded by fabric in said basket providing a total flow rate which is less than the flow rate of said recirculating means.

7. A fabric washing appliance in accordance with claim 6 wherein said basket further comprises overfill means vertically displaced above the uppermost one of said flow means and sized to permit liquid to flow from said basket to said tub at a rate greater than said total rate of flow of liquid into said basket whereby flow over the top of said basket is prevented.

8. A clothes washing appliance comprising: a liquid receiving system comprising a tub, a clothes receiving basket mounted within said tub, and recirculating means for recirculating liquid from said tub into said basket; liquid fill means for delivering liquid to said liquid receiving system; said basket having formed in the outer wall thereof a plurality of vertically spaced tiers of apertures permitting liquid flow from said basket to said tub, the apertures for each one of said tiers being arranged to provide a flow rate of said one tier when unimpeded by the clothes in said basket which in combination with the cumulative impeded flow rate of all lower tiers provides a total flow rate of liquid from said basket which exceeds the rate of flow of liquid into said basket from said recirculating means; and a flow rate for said one tier when impeded by clothes in said basket which in combination with the cumulative impeded flow rate of all lower tiers provides a total flow rate which is less than the rate of flow of liquid from said recirculating means; and liquid level sensing means responsive to the volume of liquid in said tub and operative to shut off said liquid supply means upon sensing a predetermined volume of liquid in said tub thereby terminating fill when the liquid level in said basket is not lower than the level of the lowermost unimpeded tier and not higher than the next higher tier, whereby the amount of liquid delivered to said liquid receiving system is automatically determined by the level of clothes in said basket.

9. A clothes washing appliance in accordance with claim 8 further comprising agitating means positioned in said basket operative to provide oscillating washing action in said basket and wherein said liquid level sensing means is further operative to initiate operation of said agitating means upon sensing a predetermined volume of liquid in said tub.

10. A clothes washing appliance in accordance with claim 9 wherein said basket has formed in the bottom thereof a plurality of sand holes permitting liquid to flow from said basket to said tub at a rate less than the unimpeded flow rate of the lowermost one of said tiers, the cumulative impeded flow rate of all of said tiers in combination with the flow rate through said sand holes when impeded by clothes in said basket providing a total flow rate from said basket to said tub which is less than said flow rate of said recirculating means.

11. A clothes washing appliance in accordance with claim 8 or 10 wherein said basket further comprises overfill means vertically displaced above the uppermost one of said tiers, and constructed and arranged to permit liquid to flow from said basket to said tub at a rate greater than the rate of flow of liquid into said basket whereby flow over the top of said basket is prevented.

12. A fabric washing appliance comprising: a tub; a clothes receiving basket mounted within said tub; fill means for delivering liquid into said tub; recirculating means for delivering liquid from said tub to said basket; said basket having formed in the outer wall thereof a plurality of vertically spaced tiers of apertures permitting liquid flow from said basket to said tub, the apertures for each one of said tiers being arranged to permit liquid flow at a predetermined unimpeded flow rate when the fabric in said basket is lower than said one tier and to permit liquid flow at an impeded flow rate when the fabric in said basket is above said one tier; said unimpeded flow rate of said one tier when combined with the cumulative impeded flow rate of all tiers lower than said one tier providing a total flow rate from the basket to the tub which at least equals the flow rate of said recirculating means, the cumulative impeded flow rate of all impeded tiers providing a flow rate which is less than said flow rate of said recirculating means thereby stabilizing the liquid level in said basket at the level of the lowermost tier which is unimpeded by the fabric in said basket whereby the liquid level in the basket is automatically determined by the level of fabric in the basket.

13. A fabric washing appliance in accordance with claim 12 further comprising: liquid level sensing means responsive to the volume of liquid in said tub and operative to shut off said liquid supply means upon sensing a predetermined volume of liquid in said tub; means for washing fabric in said basket including agitating means; means responsive to said liquid level sensing means and operative to prevent agitation by said agitating means when the volume of liquid in said tub is less than said predetermined volume and to enable agitation when the volume of liquid reaches said predetermined volume.

14. A fabric washing appliance in accordance with claim 13 wherein said of said tiers of apertures comprises a plurality of drain holes of uniform size, and wherein each successively higher series includes fewer holes whereby the unimpeded flow rate for each series is less than the unimpeded flow rate of the next lower series.

15. A fabric washing appliance in accordance with claim 14 wherein said basket has formed in the bottom thereof a plurality of sand holes, the unimpeded flow rate through said sand holes being less than the unimpeded flow rate for the lowermost one of said tiers, and the cumulative impeded flow rate of all of said tiers in combination with the flow rate through said sand holes when impeded by fabric in said basket providing a total flow rate which is less than said rate of said recirculating means.

16. A fabric washing appliance in accordance with claim 15 wherein said basket further comprises overfill means vertically displaced above the uppermost one of said tiers and sized to permit liquid to flow from said basket to said tub at a rate greater than said flow rate of said recirculating means whereby flow over the top of said basket is prevented.

* * * * *

UNITED STATES PATENT AND TRADEMARK OFFICE

CERTIFICATE OF CORRECTION

PATENT NO. : 4,321,809

DATED : March 30, 1982

INVENTOR(S) : John Bochan

It is certified that error appears in the above—identified patent and that said Letters Patent is hereby corrected as shown below:

Column 16, line 4, delete "said" in the first instance and insert -- each --.

Signed and Sealed this

*Sixth* Day of *July 1982*

[SEAL]

*Attest:*

GERALD J. MOSSINGHOFF

*Attesting Officer*

*Commissioner of Patents and Trademarks*